United States Patent [19]

Curran

[11] Patent Number: 4,776,262

[45] Date of Patent: Oct. 11, 1988

[54] FILTERED INSULATION BAFFLE

[75] Inventor: Laurence E. Curran, Peoria, Ill.

[73] Assignee: Air Vent, Inc., Peoria Heights, Ill.

[21] Appl. No.: 64,398

[22] Filed: Jun. 22, 1987

[51] Int. Cl.[4] ..... F24F 7/00

[52] U.S. Cl. ..... 98/37; 52/95; 55/97; 55/502; 55/385.1

[58] Field of Search ..... 52/95, 199; 55/97, 385 R, 55/502, 512; 98/32, 37, DIG. 6

[56] References Cited

U.S. PATENT DOCUMENTS

| | | | |
|---|---|---|---|
| 3,343,475 | 9/1967 | Costley | 98/37 |
| 4,189,878 | 2/1980 | Fitzgerald | 98/37 X |
| 4,214,510 | 7/1980 | Ward | 98/37 |
| 4,325,290 | 4/1982 | Wolfert | 98/42.21 |

FOREIGN PATENT DOCUMENTS

| | | | |
|---|---|---|---|
| 818784 | 8/1959 | United Kingdom | 98/37 |
| 2070662 | 9/1981 | United Kingdom | 98/DIG. 6 |

*Primary Examiner*—Harold Joyce

*Attorney, Agent, or Firm*—Silverman, Cass, Singer & Winburn, Ltd.

[57] ABSTRACT

Filtered insulation baffle that serves as a barrier against insects and other pests entering an attic space of a building while allowing free air to flow into the attic through the baffle. A housing is formed with closed sides and open ends and sized to fit into the area between adjacent rafters of the building. A filter is formed from a porous filter material that is sized larger than the open end of the housing and positioned in one end of the housing to allow the filter material to protrude from the housing. The baffle is positioned between the rafters with the filter material protruding into an opening between the roof deck and the plate structure of the building. The protruding filter material is then wedged into the opening such that a portion of the filter material will roll back on the end of the housing to seal the opening while allowing free air to pass through the baffle and into the attic space of the building.

16 Claims, 1 Drawing Sheet

FIG. 1
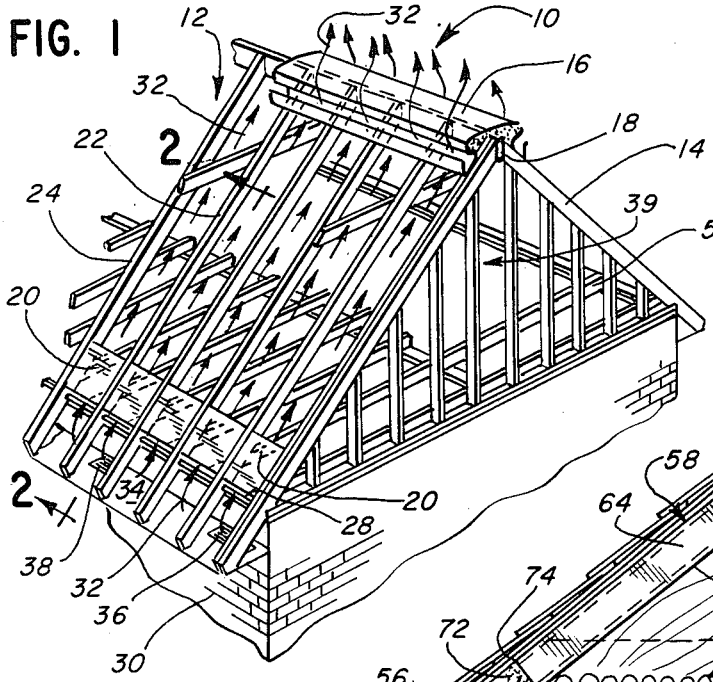
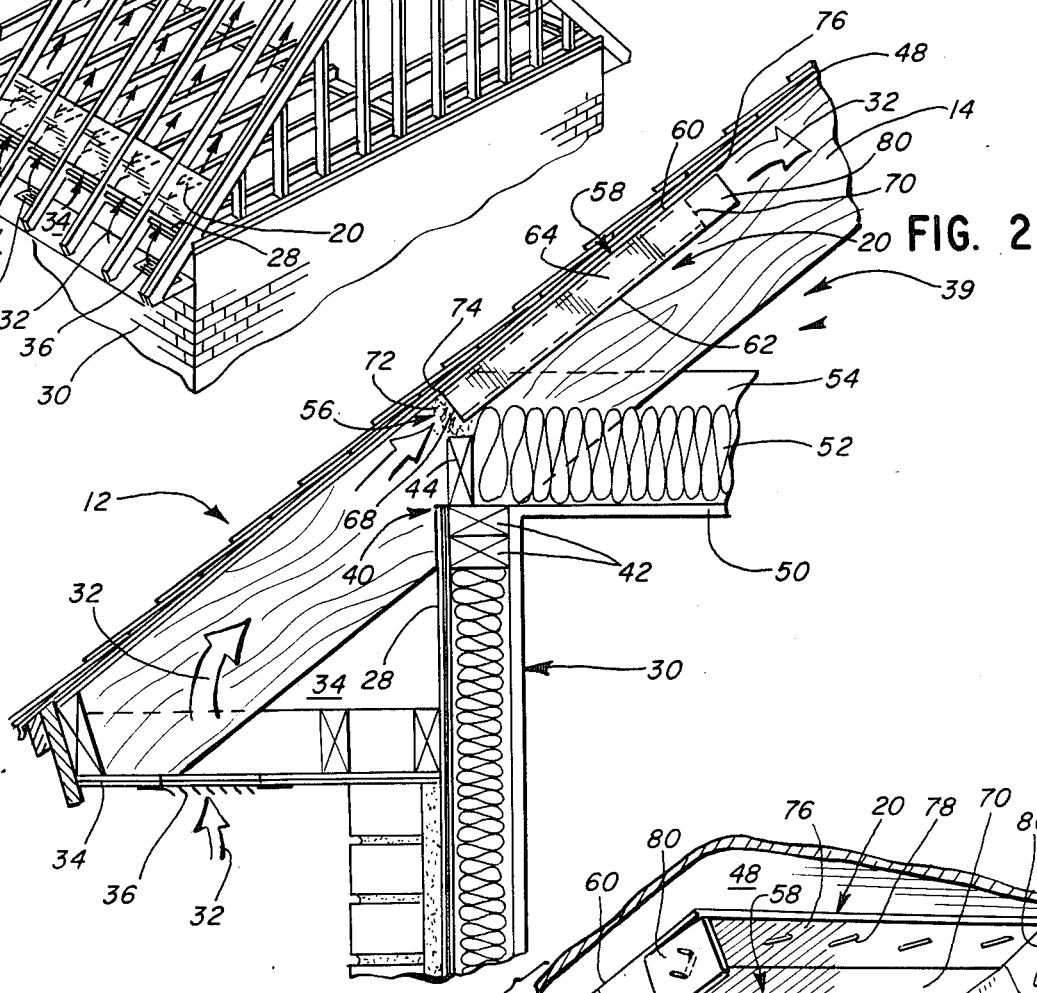
FIG. 2
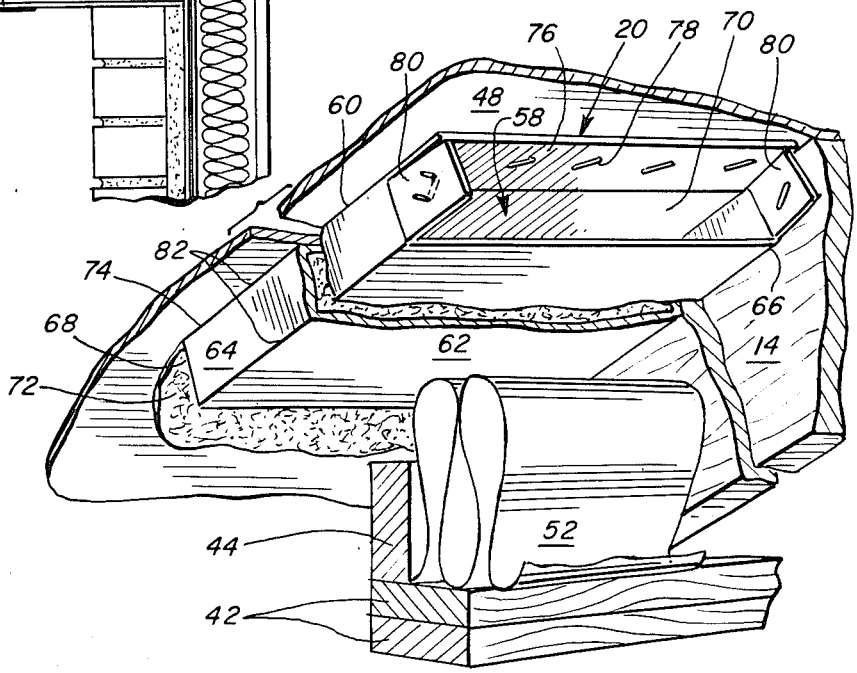
FIG. 3

FILTERED INSULATION BAFFLE

BACKGROUND OF THE INVENTION

The invention relates generally to attic ventilators and more particularly to an improved ventilator that serves as a barrier against insects and other pests.

Proper and effective attic ventilation of a residential building is necessary in order to prevent accumulation of water vapor in the attic or vacant space below the roof of a building. Such water vapor will condense in a cold attic or crawl space above the living quarters sufficiently to reduce the rating of insulation installed in the attic and can have deleterious effects on the structure of the roof. An important aspect of an attic ventilation system is the cooperation between a soffit ventilator and a roof ridge ventilator or other roof ventilators that will allow air flow through the attic space such that water vapor accumulation in the attic can be avoided.

Whenever openings are provided in a building for air flow, these openings also provide access for insects and other undesirable pests that can cause damage to the attic or threaten human health. Conventional soffit ventilators have attempted to utilize wire screens to prevent penetration of insects and other pests into the attic. However, where the mesh gauge of the screen is fine enough to restrict the entry of smaller insects, the screen will undesirably restrict the flow of air through the ventilator.

Therefore, there is a need for a ventilator that is capable of preventing the penetration of substantially all insects or other pests into the attic through the ventilation openings without restricting air flow.

SUMMARY OF THE INVENTION

The disadvantages of prior art ventilators are overcome in accordance with the present invention by providing a baffle or ventilator that can be utilized in conjunction with the soffit ventilator and roof ridge ventilator or other roof ventilators. The baffle has a housing with closed sides and open ends. The housing, sized to fit into the area between adjacent rafters of a building, is provided with a porous filter material sized larger than one open end of the housing and positioned to protrude from the housing. The baffle is placed between adjacent rafters and the protruding filter material is wedged into an opening between the roof deck and the plate structure of the building to force a portion of the protruding filter material to roll back on the end of the housing thus sealing the opening against insects and other pests while allowing free air flow through the baffle and into the attic space of the building.

BRIEF DESCRIPTION OF THE DRAWINGS

FIG. 1 depicts a partial perspective view of a conventional residential building with the rafters exposed to show installation of the filtered insulation baffle embodying the invention;

FIG. 2 is a partial sectional view taken along line 2—2 of FIG. 1 and in the direction indicated generally; and FIG. 3 is a perspective cut away view of the filtered insulation baffle as installed between the rafters of a building with one rafter not shown.

DESCRIPTION OF THE PREFERRED EMBODIMENT

Referring to FIG. 1, a residential building 10 has a conventional roof 12 formed by rafters 14. The roof 12 is shown having an insulated or screened roof ridge ventilator 16 installed over the ridge 18 of the roof 12 in the conventional manner. The ventilator or baffle of the present invention is designated generally by the reference numeral 20 and is shown located between pairs of adjacent rafters 14. The baffle 20 is further positioned such that the baffle 20 abuts a top edge 28 of exterior building wall 30.

An air flow pattern, indicated by arrows 32, enters an enclosed eave 34 through a conventional soffit ventilator 36 located in soffit 38. The air flow 32 then passes through the baffle 20 to enter an attic space 39 interior to the roof 12 (best seen in FIG. 2). The air flow 32 continues through the attic space 39 to exit through the roof ridge ventilator 16. In this way, air is allowed to flow through the attic space 39 in order to prevent the accumulation of water vapor therein and the resulting damage to any insulation installed in the attic or to the structure of the roof.

Referring to FIG. 2, a plate structure 40 is located along the top edge 28 of the exterior building wall 30. The plate structure 40 can be in the form of a plate, a filler, or a blocking piece either separately or in combination. The plate structure 40 illustrated in FIG. 2 is shown having both plates 42 and a filler 44. The roof 12 is mounted to the plate structure 40 such that a portion of the rafter 14 extends beyond the exterior wall 30 to the enclosed eave 34.

The attic space 39 is substantially enclosed at its upper margin by a roof deck 48 mounted to the rafters 14, and at its lower margin by a ceiling 50 which is shown with an overlying layer of insulation 52 placed between adjacent ceiling joists 54. In this view, it can be seen that an opening 56 into the attic space 39 occurs where the plate structure 40 and the roof deck 48 meet. The opening 56 is an access point where insects and other undesirable pests can enter the attic and cause damage.

Conventional ventilators have attempted to prevent the entry of insects into the attic space 39 by providing a sheet of screen mesh in conjunction with the soffit ventilator 36. However, screen mesh has been highly unsatisfactory for restricting smaller insects from entering the attic space 39. When the mesh gauge is small enough to restrict small insects, it also restricts the flow of air through the screen. In addition, spaces or gaps may occur in places along the enclosed eave 34 that are not protected by the screen mesh, thus allowing the entry of insects or other pests even when a screen mesh is provided. Once the insects or pests have gained access to the enclosed eave 34 it is a simple matter to enter the attic space 39 through the opening 56. In contrast, the baffle 20 of the present invention provides a barrier to prevent insects and other pests from entering the attic space 39 through the opening 56, while allowing air flow 32 through the baffle 20.

The baffle 20 of the present invention is illustrated in greater detail in FIG. 3. The housing 58 is illustrated adjacent one rafter 14. For simplicity, the adjacent rafter is not shown in this view. The housing 58 is seen to have an upper wall 60, a lower wall 62, and side walls 64 and 66. Further, the housing 58 has open ends 68 and 70 allowing free air to flow therethrough, as illustrated by the arrows 32 in FIG. 2. A filter 72, formed from a porous filter material such as fiberglass, is sized larger than the open end 68 of the housing 58 such that when the filter 72 is partially compressed and fitted into one end 68 of the housing 58, a portion of the filter 72 remains expanded and protrudes out of the open end 68.

As seen in FIG. 2, the baffle 20 is positioned adjacent the rafters 14. The upper surface of the wall 60 is placed adjacent the roof deck 48, leaving the lower surface of the wall 62 exposed to the attic space 39. The baffle 20 is then slid toward the opening 56 until the filter 72 protrudes into the opening 56. The opening 56 is further sealed by wedging the filter 72 into the opening 56 thus forcing a portion of the filter 72 to roll back upon an edge 74 surrounding the opening 56 of the housing 58 to provide a seal or gasketing effect against the surfaces surrounding the opening 56. Thus, insects and other pests are prevented from gaining access to the attic space 39 by either going around the baffle 20 or through the filtered insulation. At the same time, the air flow 32 is not substantially disturbed.

In the conventional roof found on the residential building 10, the rafters 14 are generally spaced either sixteen inches on center or twenty-four inches on center. The dimensions of the housing 58 correspond to the spacing between the rafters 14. For example, where the rafters are sixteen inches on center, the housing 58 should be dimensioned to fit between those rafters and where the rafters are twenty-four inches on center, a different housing should be utilized; one sized to fit the larger spacing between those rafters. Additionally, to obtain adequate protection against insects and other pests, one baffle 20 should be placed in each rafter spacing between adjacent rafters.

A securing means for securing the filter 72 to the housing 58 can be provided. Any attaching mechanism, such as adhesive or hot melt, that securely fastens the filter 72 to the housing 58 would be suitable.

The filtered insulation baffle 20 can also be provided with flaps for attachment to the roof deck 48 and the rafters 14 to secure the baffle 20 in place. As seen in FIG. 3, an upper flap 76 extending along and in substantially the same plane as at least a portion of the upper wall 60 of the housing 58 is illustrated fixed to the roof deck 48 by metal staples 78. However, any suitable fixing means can be substituted for the metal staples 78. Similarly, side flaps 80 can be provided to extend along and in substantially the same plane as at least one side wall 64 or 66. The side flap 80 can be attached to the adjacent rafters 14 further securing the baffle 20 in place between adjacent rafters 14.

Additionally, the baffle 20 can be hinged, for example along edges 82, such that the housing 58 will collapse into an substantially flat unit (not shown). This characteristic is particularly valuable for shipping and/or storing the baffle 20.

Modifications and variations of the present invention are possible in light of the above teachings. The dimensions are not critical to the invention so long as the housing 58 extends between the adjacent rafters 14 and the filter material 72 protrudes into, and seals, the opening 56 against insects and other pests. The types of materials utilized are not critical to the invention, but a convenient filter material is fiberglass and a convenient housing material is a paperboard that has been moisture protected. It is therefore to be understood that within the scope of the appended claims, the invention may be practiced otherwise than as specifically described.

What is claimed and desired to be secured by Letters Patent of the United States is:

1. A method of preventing insects and other pests from entering into an attic space through an opening between the roof deck and the plate structure of a building in the area between adjacent rafters of the building while allowing free air to flow into the attic through the housing comprising:

forming a housing having an upper wall, a lower wall, and side walls, said housing sized to fit adjacent the roof deck in the area between adjacent rafters, said housing further having open ends to allow free air flow through said housing;

forming a filter in at least one of said open ends of said housing from a porous filter material sized larger than said open end and secured to protrude from said end of said housing;

said housing including at least one flap adjacent said upper wall and extending beyond the open end of said housing in substantially the same plane as said upper wall whereby said housing may be at least partially supported between adjacent rafters by securing said flap to the underside of the roof deck; and securing said housing between the adjacent rafters of the building such that said porous filter material protrudes into said opening to prevent insects and other pests from entering into the attic space while allowing free air to flow through said housing into the attic space of the building.

2. The method as defined in claim 1 including providing at least one side flap adjacent said side wall and extending beyond said open end of said housing in substantially the same plane as said side wall such that said housing can be mounted between adjacent rafters by securing said upper flap to the roof deck and said side flap to the rafter.

3. The method as defined in claim 1 including the steps of wedging said porous filter material partially into said opening and causing a portion of said filter material to roll back on a portion of said housing to engage and substantially fill said opening.

4. The method as defined in claim 3 wherein said porous filter material is fiberglass.

5. A combination filtered insulation baffle and ventilation conduit that serves both as a barrier against insects and other pests entering an attic space through the plate structure of a building and a means for ventilating said space positioned in the area between adjacent rafters of the building, while allowing free air to flow into the attic through the housing comprising:

a housing having an upper wall, a lower wall, and side walls, said housing sized to fit adjacent the roof deck in the area between adjacent rafters, said housing further having open ends to allow free air flow through said housing;

said housing further including at least one flap adjacent said upper wall and extending beyond the open end thereof in substantially the same plane as said roof deck, whereby said housing may be mounted between adjacent rafters by securing said upper flap to the underside of said roof deck; and a filter located in at least one of said ends, said filter formed from a porous filter material sized larger than said open end and positioned in said open end to protrude from said end of said housing such that when said housing is located between adjacent rafters of the building, said porous filter material protrudes into said opening to prevent insect and other pests from entering into the attic space while allowing free air to flow through said housing into the attic space of the building.

6. The baffle as defined in claim 5 including at least one side flap adjacent said side wall and extending beyond said open end of said housing in substantially the same plane as said side wall such that said housing can be mounted between adjacent rafters by securing said side flap to the rafter.

7. The baffle as defined in claim 5 including means for securing said protruding filter material to said housing.

8. The baffle as defined in claim 7 wherein said filter material protrudes from said end of said housing an amount sufficient that a portion of said filter material will roll back on a portion of said housing to seal said opening as said filter is wedged into said opening.

9. The baffle as defined in claim 5 wherein said porous filter material is fiberglass.

10. The baffle as defined in claim 5 wherein said side walls are hinged to enable said housing to collapse into a substantially flat unit.

11. A filtered insulation baffle comprising:

a housing having an upper wall, a lower wall, and side walls, said housing sized to fit adjacent a roof deck in the area between adjacent rafters of a building, said housing further having open ends to allow free air flow through said housing;

a filter located in at least one of said ends, said filter formed from a porous filter material sized larger than said open end and positioned in said open end to protrude from said end of said housing; and at least one upper flap adjacent said upper wall and extending beyond said open end of said housing in substantially the same plane as said upper wall such that said housing can be mounted between adjacent rafters by securing said upper flap to said roof deck.

12. The baffle as defined in claim 11 including at least one side flap adjacent said side wall and extending beyond said open end of said housing in substantially the same plane as said side wall such that said housing can be mounted between adjacent rafters by securing said upper flap to the roof deck and said side flap to the rafter.

13. The baffle as defined in claim 11 including means for securing said protruding filter material to said housing.

14. The baffle as defined in claim 13 wherein said filter material protrudes from said end of said housing an amount sufficient that a portion of said filter material will roll back on a portion of said housing as said filter is wedged into a confined space.

15. The baffle as defined in claim 11 wherein said porous filter material is fiberglass.

16. The baffle as defined in claim 11 wherein said side walls are hinged to enable said housing to collapse into an substantially flat unit.

* * * * *